US009289015B2

(12) United States Patent
Kassis

(10) Patent No.: US 9,289,015 B2
(45) Date of Patent: Mar. 22, 2016

(54) BIB APPARATUS FOR CONTAINING LIQUID OR OTHER DEBRIS

(71) Applicant: Ellen Kassis, Chicago, IL (US)

(72) Inventor: Ellen Kassis, Chicago, IL (US)

( * ) Notice: Subject to any disclaimer, the term of this patent is extended or adjusted under 35 U.S.C. 154(b) by 0 days.

(21) Appl. No.: 14/013,881

(22) Filed: Aug. 29, 2013

(65) Prior Publication Data

US 2014/0059733 A1 Mar. 6, 2014

Related U.S. Application Data

(60) Provisional application No. 61/695,418, filed on Aug. 31, 2012.

(51) Int. Cl.
*A41B 13/10* (2006.01)
*A41B 13/00* (2006.01)

(52) U.S. Cl.
CPC ..... *A41B 13/103* (2013.01); *A41B 13/10* (2013.01); *A41B 13/106* (2013.01)

(58) Field of Classification Search
CPC .. A41B 13/103; A41B 2400/52; A41B 13/10; A41B 13/106; A47G 2023/0675; A47G 23/06; A47G 23/0608; A45F 2003/002; A45F 2003/007; A45F 2005/006; A45F 3/14; A45F 2005/002; A45F 3/02; A47B 23/002; A47B 31/06; A41D 13/04; A41D 13/0518; A41D 13/0012; Y10S 2/913; A47D 1/008; A47D 15/006; A61B 19/08
See application file for complete search history.

(56) References Cited

U.S. PATENT DOCUMENTS

| | | | | | |
|---|---|---|---|---|---|
| 996,084 | A | * | 6/1911 | Herring | 2/49.2 |
| 1,592,283 | A | * | 7/1926 | McKenzie | 2/48 |
| 2,164,369 | A | * | 7/1939 | Woolever | 2/49.1 |
| 2,265,690 | A | * | 12/1941 | Fiedler | 2/48 |
| 2,289,945 | A | * | 7/1942 | Wadsack | 224/197 |
| 2,304,705 | A | * | 12/1942 | Pate | 224/258 |
| 2,424,000 | A | * | 7/1947 | Shanker | 2/49.1 |
| 2,424,680 | A | * | 7/1947 | Doyle | 428/43 |
| 2,468,841 | A | * | 5/1949 | Siegel | 2/463 |
| 2,469,835 | A | * | 5/1949 | McMartin | 2/49.3 |
| 2,510,646 | A | * | 6/1950 | Meers | 224/265 |
| 2,523,565 | A | * | 9/1950 | Gardner | 2/49.1 |
| 2,532,932 | A | * | 12/1950 | Neiswander | 2/49.2 |
| 2,629,870 | A | * | 2/1953 | Hudson | 2/49.1 |
| 2,672,614 | A | * | 3/1954 | Zimmerman et al. | 2/49.3 |
| 2,697,222 | A | * | 12/1954 | Reid | 2/49.2 |
| 2,704,625 | A | * | 3/1955 | Huse | 224/576 |
| 2,738,511 | A | * | 3/1956 | Brady | 2/49.2 |
| 2,766,455 | A | * | 10/1956 | Klaine | 2/49.5 |
| 2,782,420 | A | * | 2/1957 | Barager | 2/49.3 |
| 3,001,646 | A | * | 9/1961 | Cooper | 242/160.1 |
| 3,009,613 | A | * | 11/1961 | Noland | 224/265 |
| 3,061,390 | A | * | 10/1962 | Walsh et al. | 108/43 |

(Continued)

*Primary Examiner* — Bobby Muromoto, Jr.
(74) *Attorney, Agent, or Firm* — Kagan Binder, PLLC

(57) ABSTRACT

A bib apparatus for containing liquid is provided that is made of a light-weight material that can hold its shape. The bib apparatus connects around the user's neck and sits over the user's shoulders and under the chin or may connect around the user's chest. The bib apparatus contains a recess that drains into a drain hole. The drain hole extends into a reservoir member that can contain liquid or debris. The reservoir member can hang at an angle towards the user's chest so as to hold the shelf horizontally under the user's chin. The device described herein is applicable to seniors, physically and mentally-challenged patients and for use by dental and medical professionals in connection with related procedures.

15 Claims, 2 Drawing Sheets

(56) References Cited

U.S. PATENT DOCUMENTS

| | | | | | |
|---|---|---|---|---|---|
| 3,146,464 | A | * | 9/1964 | Burnett | 2/49.3 |
| 3,329,969 | A | * | 7/1967 | Roberts, Jr. et al. | 2/49.3 |
| 3,407,407 | A | * | 10/1968 | Hollander et al. | 2/49.2 |
| 3,541,976 | A | * | 11/1970 | Rozas | 108/43 |
| 3,597,763 | A | * | 8/1971 | Bienvenu | 2/49.3 |
| 3,822,473 | A | * | 7/1974 | Jones | 433/38 |
| 3,945,048 | A | * | 3/1976 | Shearer | 2/48 |
| 4,114,199 | A | * | 9/1978 | Malan | 2/49.3 |
| 4,261,057 | A | * | 4/1981 | Andersson | 2/49.3 |
| 4,416,025 | A | * | 11/1983 | Moret et al. | 2/49.3 |
| 4,445,231 | A | * | 5/1984 | Noel | 2/49.3 |
| 4,569,086 | A | * | 2/1986 | Takefman | 2/49.2 |
| 4,601,065 | A | * | 7/1986 | Sigl et al. | 2/49.2 |
| 4,649,572 | A | * | 3/1987 | Roessler | 2/49.2 |
| 4,660,226 | A | * | 4/1987 | Quilling et al. | 2/49.2 |
| 4,779,288 | A | * | 10/1988 | Mack | 2/49.3 |
| 4,793,004 | A | * | 12/1988 | Long et al. | 2/49.3 |
| 4,860,381 | A | * | 8/1989 | Bartley | 2/49.3 |
| 4,862,518 | A | * | 9/1989 | Williams et al. | 2/49.1 |
| 4,869,271 | A | * | 9/1989 | Idris | 128/853 |
| 4,887,315 | A | * | 12/1989 | Bezdek | 2/46 |
| 4,915,278 | A | * | 4/1990 | Smith | 224/601 |
| 4,924,527 | A | * | 5/1990 | Hintermeyer | 2/46 |
| 4,946,094 | A | * | 8/1990 | Stang | 224/270 |
| 4,985,932 | A | * | 1/1991 | Bezdek | 2/49.2 |
| 5,056,159 | A | * | 10/1991 | Zemke, Jr. | 2/46 |
| 5,062,558 | A | * | 11/1991 | Stang | 224/270 |
| 5,074,222 | A | * | 12/1991 | Welch | 108/43 |
| D323,435 | S | * | 1/1992 | Palacios | D6/406.3 |
| 5,107,545 | A | * | 4/1992 | Potter | 2/46 |
| 5,181,275 | A | * | 1/1993 | Spulgis | 2/48 |
| 5,218,721 | A | * | 6/1993 | Mathews et al. | 2/49.2 |
| 5,221,032 | A | * | 6/1993 | Bott et al. | 224/270 |
| 5,285,940 | A | * | 2/1994 | Goulter | 224/148.4 |
| 5,421,499 | A | * | 6/1995 | Bauer | 224/270 |
| 5,429,057 | A | * | 7/1995 | Buescher | 108/43 |
| 5,551,615 | A | * | 9/1996 | McIntosh | 224/270 |
| 5,642,674 | A | * | 7/1997 | Joye et al. | 108/43 |
| 5,649,654 | A | * | 7/1997 | Hayward, Jr. | 224/270 |
| 5,666,665 | A | * | 9/1997 | Morgado | 2/49.1 |
| 5,701,605 | A | * | 12/1997 | Bowen | 2/49.1 |
| 5,956,763 | A | * | 9/1999 | Blackshear | 2/49.1 |
| 6,021,521 | A | * | 2/2000 | Baratta | 2/49.1 |
| 6,058,506 | A | * | 5/2000 | Reinhart, Jr. | 2/49.2 |
| 6,095,058 | A | * | 8/2000 | Earnhart | 108/43 |
| 6,105,165 | A | * | 8/2000 | Johnson et al. | 2/49.2 |
| 6,128,781 | A | * | 10/2000 | Spindler | 2/49.3 |
| 6,158,052 | A | * | 12/2000 | Smith | 2/46 |
| 6,243,869 | B1 | * | 6/2001 | Ekovich | 2/48 |
| 6,481,016 | B1 | * | 11/2002 | Rees | 2/49.1 |
| 6,581,210 | B2 | * | 6/2003 | Kaloustian | 2/49.1 |
| D483,961 | S | * | 12/2003 | Hasz | D6/419 |
| 6,708,341 | B1 | * | 3/2004 | Schaller | 2/51 |
| 6,732,375 | B2 | * | 5/2004 | Nornes | 2/49.1 |
| 6,826,780 | B1 | * | 12/2004 | Romesburg | 2/49.2 |
| 7,076,807 | B2 | * | 7/2006 | Bergkvist | 2/49.1 |
| 7,143,448 | B1 | * | 12/2006 | Gottehrer | 2/49.2 |
| 7,269,856 | B1 | | 9/2007 | Cannan | |
| 7,269,857 | B2 | | 9/2007 | Cymbol | |
| 7,367,065 | B2 | * | 5/2008 | Gregg | 2/50 |
| 7,469,425 | B2 | * | 12/2008 | DeStefano | 2/49.3 |
| 7,591,401 | B2 | * | 9/2009 | Sandler | 224/201 |
| 7,716,749 | B2 | * | 5/2010 | Perazzo | 2/49.1 |
| 7,806,305 | B1 | * | 10/2010 | Moore et al. | 224/265 |
| 8,151,370 | B2 | * | 4/2012 | Perazzo | 2/49.1 |
| 8,157,137 | B1 | * | 4/2012 | Laird | 224/258 |
| 2007/0143904 | A1 | * | 6/2007 | Brown | 2/49.1 |
| 2009/0188016 | A1 | * | 7/2009 | Arthur-Mensah et al. | 2/49.4 |
| 2010/0088796 | A1 | * | 4/2010 | Perazzo | 2/49.3 |
| 2010/0311026 | A1 | * | 12/2010 | Tomes et al. | 434/262 |
| 2011/0067161 | A1 | * | 3/2011 | Perazzo | 2/49.3 |

* cited by examiner

BIB APPARATUS FOR CONTAINING LIQUID OR OTHER DEBRIS

CROSS-REFERENCE TO RELATED APPLICATION

This application claims priority to and the benefit of U.S. Provisional Application No. 61/695,418, filed Aug. 31, 2012, the entire contents of which are incorporated herein by reference in its entirety.

FIELD OF THE INVENTION

The present disclosure is directed to a personal bib apparatus for containing liquid and other debris related to feeding and burping an infant or other individual.

BACKGROUND

Infants generally need to be burped intermittently during feedings while held up in a sitting position. Currently there are a number of bib solutions for catching an infant's spit-up during burping. However, the bibs on the market today rest against a baby's torso in a way that allows spit-up to project past the bib. If spit-up happens to land on currently-available bibs, the spit-up eventually reaches an infant's and/or caregiver's clothing. For instance, fabric bibs allow spit-up to soak through to a baby's clothes, and synthetic bibs allow liquid to slide off onto a baby's and/or caregiver's clothes. Bibs with a pocket at the bottom are not able to hold a liquid mess either—either the pocket is flat and liquids miss it, or, if liquid lands in a held-open pocket, the liquid spills back out once an infant is moved or pressed against a caregiver. Moreover, an infant is able to put his/her hands in the liquid caught in the pocket, thus causing a further mess.

SUMMARY

A bib apparatus would be advantageous that contains a reservoir member for collecting spit-up that can be used without having to be held by a caregiver. It would also be advantageous to have a reservoir member that contains spit-up out of a caregiver's or infant's sight. Still further, it would be advantageous to have a reservoir member for containing spit-up that holds the spit-up in a location that is not easily accessible by the infant.

The bib apparatus described herein also prevents slouching while feeding the infant or any other user, which alleviates another set of challenges caused by current bibs on the market. With current bibs on the market, all of which rest vertically against infant's chest, parents usually need to hold bib up to infant's mouth while burping to attempt to catch spit-up. Not only does this not work to catch the spit-up, but it also aggravates the burping challenge. It is important to hold the infant upright while burping, which is an optimal position to alleviate pressure on the stomach caused by slouching. When holding other bibs up under infant's chin while patting baby's back with the other hand while burping, the infant is left without support and slouches forward, causing pressure on the stomach which in turn aggravates spit-up or reflux. In one example embodiment of the bib taught herein, the bib apparatus is hands-free so that it effectively catches and contains spit up without needing to be held up to the infant's mouth, so that one hand can hold infant upright by the chest while other hand pats the infant's back to burp.

In one example embodiment of the bib apparatus, the bib apparatus described herein provides an advantage over the prior art in that it provides a bib for infants (and in a related embodiment to seniors or those that may be physically or mentally-challenged) that is comprised of a reservoir member for containing spit-up that is hands-free, not accessible by an infant, out of a caregiver's or infant's sight, and spill-proof. The bib apparatus described herein also provides an advantage over the prior art in that it contains spit-up without soaking the user's clothes or furniture or making clean up more difficult and time-consuming.

An advantage of one embodiment of the bib apparatus is a rim structure around the neck, which is unlike current bibs on the market. The rim structure rests flat around infant's neck and does not allow liquid to seep under as it drips from infant's chin. The rim around the neck of the bib apparatus is curved up and over so that it can fit snugly without digging into baby's neck, and it substantially prevents liquid from seeping underneath the bib. Also, the curvature of the rims are not limited to the ones disclosed herein and maybe whatever shape that prevents seepage.

In one example embodiment, a bib apparatus for containing liquid or other debris is provided that is comprised of a semi-circle shelf (or plate member) that connects around an infant's neck and sits horizontally over the infant's shoulders and under the infant's chin. The rim of the shelf curves upwards so as to contain liquid that lands on the shelf. The shelf slants inward toward a shallow recess located in the middle section of the shelf. The middle of the shallow recess contains a drain hole. The drain hole may extend longitudinally into a reservoir member that hangs underneath the shelf that can contain liquid or other debris that drains into it.

In another example embodiment, a bib apparatus for containing liquid or debris is provided that is made of a lightweight material that is soft and malleable but holds its shape. The bib apparatus is comprised of a semi-circle shelf that connects around an infant's neck and sits horizontally over the infant's shoulders and under the infant's chin. The rim of the shelf curves upward so as to contain liquid or other debris that lands on the shelf. The shelf slants inward toward a shallow recess located in the middle section of the shelf. The middle of the shallow recess may contain a drain hole. The drain hole can extend longitudinally into a reservoir member that hangs underneath the shelf and that can contain liquid and debris that drains into it. The reservoir member hangs at an angle towards the infant's chest and can rest on the chest so as to hold the shelf up under the infant's chin. The reservoir member is comprised of a wide spherical base and a neck congruous with the shelf. In other related embodiments, the reservoir member is removably coupled to the shelf. In other related embodiments, other shapes for the shelf are envisioned and these embodiments are not limited to usage with infants.

In yet another related embodiment, an apron is provided with a shelf for capturing debris or liquid for use with an able-bodied adult when sitting at table or simply cooking and debris or liquids can fly that would otherwise land on the floor or on their clothing. Such an apron can also be used in working with crafts or even while painting a ceiling or a wall to prevent paint drops from landing on the floor. In another related embodiment, the apron device is used as a shelf by a beautician or the user when putting make-up on or if the user is being made-up) for various cosmetics to rest thereon and to prevent spillage or drops falling and staining the user's clothes as the device rests under the user's chin or around the upper chest.

In yet another related embodiment, the apron device is used by a dental or other health professional to capture liquid or debris or saliva, especially in cases where the suction system is not available or easily accessible or the patient is struggling to spit out the contents. This device is available if the patient is partially anesthetized and cannot spit out. Other surgical facial treatments by other health professionals will find the apron or bib device useful in their practice.

In another example embodiment, instead of the bib having a drain hole in the center, there is a slit across the middle of the shelf that drops into a lengthwise pocket that hangs at an angle and rests on chest. Such as pocket may be useful for disabled adults or elderly individuals who need help containing food or drink that spills back out of their mouth. In this example embodiment, the bulb portion beneath the shelf would instead be a rectangular shaped compartment that hangs perpendicularly to the shelf and holds a larger volume for adult use. In a related embodiment, the bib apparatus is configured to be tied or secured around the user's upper chest (and under the arms) so as to function as a bib apparatus without the appearance of a bib for the user.

In related embodiments, different shapes are feasible and the rim itself is capable of containing liquids or debris irrespective of the catch bubble or its shape including the wide base, long neck, and flatness on one side such that liquid has some leeway to rise if bubble is squeezed or bib is moved without liquid flowing back out.

In yet another embodiment, the protective bib member has a plate member that has a top surface and bottom surface. The top surface has an outer rim and a recessed surface having an inner rim concentric to the outer rim. The recessed surface may have a drain hole that extends from the top surface through to the bottom surface. A reservoir member may be coupled to the drain hole to collect liquid and other debris exiting the recessed surface. The plate member also may have a collar portion operatively coupled thereto to support the plate member under a user's chin.

In a related embodiment, the reservoir member is configured to hang at an angle toward the user and adapted to hold the plate member substantially horizontal while the reservoir member is in contact with the user's chest. The reservoir member may have a one-way value to allow for flow into the reservoir member, but not allow liquid or debris to flow out. The reservoir member may be made from a rigid plastic, rubber, or a disposable material such as a plastic bag. The reservoir member may be shaped as a sphere, cylinder, oval, or other shape known to those of ordinary skill. The reservoir member may be connected to the plate member by a fastening system such as a snap-fit, a threaded fit, or a friction fit.

In still yet another embodiment, the protective bib may have plate member with a top surface and bottom surface having an outer rim and a recessed surface, the recessed surface may have a drain hole that extends through the top surface to the bottom surface. The bib also contains a support means that is operatively coupled to the plate member and is configured to support the plate member against the user's chest.

The bib may further include a plate member with an inner rim concentric to the outer rim. The bib may also include a reservoir member to collect liquid and debris operatively coupled to the drain hole and bottom surface of the plate member. The bib may also include a support means that is expandable for sizing around a user's chest to accommodate users of different sizes. The plate member may be shaped as a circle, oval, square, or rectangle. The reservoir member in one embodiment is a indentation that protrudes down and is molded into the main plate member for easy cleaning.

An example method of preventing liquid or debris from contacting a user's lap, includes providing a plate member having a top surface and a bottom surface, the top surface has a rim and a recessed surface, and the recessed surface has a drain hole extending from the top surface through to the bottom surface. A reservoir member is then provided that is coupled to the drain hole and bottom surface of the plate member, and the reservoir member configured to collect liquid and debris exiting the recessed surface through the drain hole. A support portion is then provided that is also operatively coupled to the plate member for supporting plate member under the user's chin.

The method may further include providing a reservoir member that is connected to the drain hole by a fastening system such as a snap-fit, a threaded fit, or a friction fit. The support portion can be configured to expand in size to accommodate users of various sizes. The plate member or shelf is positionable substantially horizontal to the user.

DETAILED DESCRIPTION

Following below are more detailed descriptions of various embodiments of the invention described herein. In particular, the various embodiments disclosed herein describe a bib or apron apparatus for containing liquid that is hands-free and spill proof, so that liquid is not accessible by an infant and out of a caregiver's or infant's or user's sight. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

Figure 1:
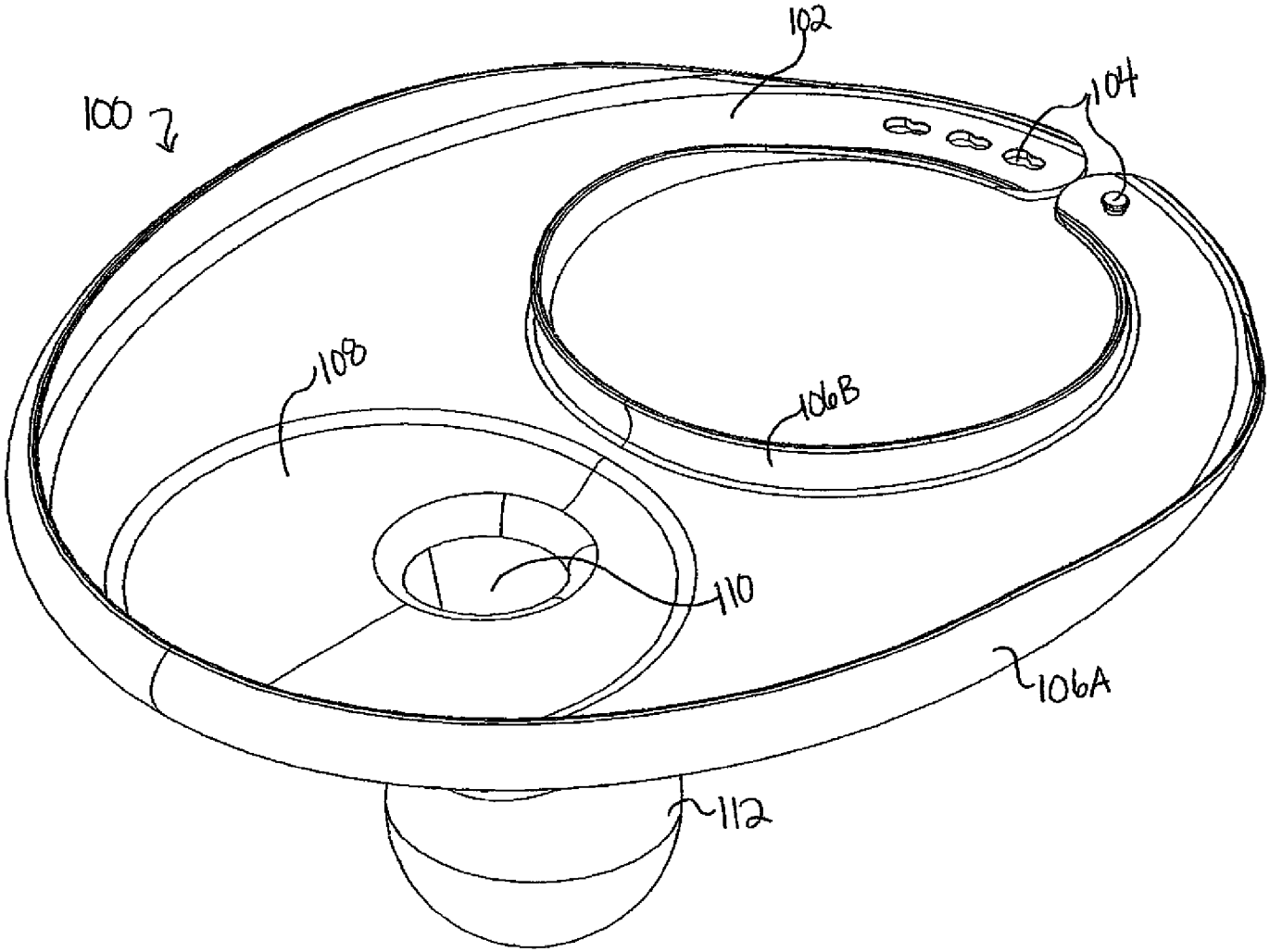
FIG. 1 is a top view of a bib apparatus as taught herein for containing liquid and other debris.

Referring to FIG. 1, in an example embodiment, a bib apparatus 100 is provided that is comprised of one continuous piece of lightweight material. In one embodiment, the continuous piece of bib apparatus 100 is made of translucent rubber that is seamless and that is easily washable. In another example embodiment, the continuous piece of bib apparatus 100 is made of any material that is soft and malleable and easily cleanable or washable. In still other embodiments, the continuous piece of bib apparatus 100 is made of light-weight opaque rubber or silicone-based translucent material, or any other non-toxic material that is safe for an infant. In another example embodiment, the continuous piece of bib apparatus 100 is made of a type of rubber material that can hold its shape despite being light-weight. In this way, a caregiver can carry an infant against the caregiver's chest while the bib apparatus 100 bends to conform, rather than poking an infant or caregiver. Once the bib apparatus 100 is released from between the bodies of a caregiver and infant, the bib apparatus 100 can pop back into its original shape.

In another example embodiment, the bib apparatus 100 is comprised of two or more pieces. A first piece may be a shelf or plate member 102, a closure mechanism 104, an inner rim 106B, an outer rim 106A, and a recess 108, while a second piece may be a reservoir member 112. Reservoir member 112 may be operatively coupled to the first piece by a fastening system such as a snap-fit, threaded fit, friction fit, or other method know to those of ordinary skill. In still yet another embodiment, bib apparatus 100 may contain a third piece such as closure 104. The pieces may be disassembled for cleaning and reassembled when in use.

In an example embodiment for adult use, other materials that are harder and less pliable are used (such as hard rubber or plastic) that allow the apparatus to hold a larger volume. In such embodiment, the lightweight and malleable characteristics would not be crucial as they would be for the embodiment for infant use.

As shown in FIG. 1, in an example embodiment, bib apparatus 100 is comprised of a semi-circle shelf 102 that can connect behind an infant's neck via closure 104. Closure 104 is comprised of various sizes that are adjustable so that bib apparatus 100 can fit an infant's neck as the infant grows. Examples of suitable adjustable closures 104 include, without limitation, snaps, buttons and hook and loop fasteners (e.g., Velcro®) or simply an elastic or expandable band. Referring to FIG. 1, shelf 102 allows bib apparatus 100 to sit horizontally over an infant's shoulders and under an infant's chin. In one example embodiment, shelf 102 is comprised of an outer rim 106A and inner rim 106B. In one example embodiment, outer rim 106A and inner rim 106B can curve upwards so as to contain liquid that lands on shelf 102.

Referring again to FIG. 1, in another embodiment, shelf 102 can slant inward toward a shallow recess 108 located in the middle section of shelf 102. The middle of shallow recess 108 can contain a drain hole 110. Drain hole 110 can extend longitudinally into a reservoir member 112 that hangs underneath shelf 102 and that can contain liquid or debris that drains into it. In one example embodiment, reservoir member 112 is bulb-shaped, or any other shape that is ergonomical and comfortable for an infant to wear.

Figure 2:
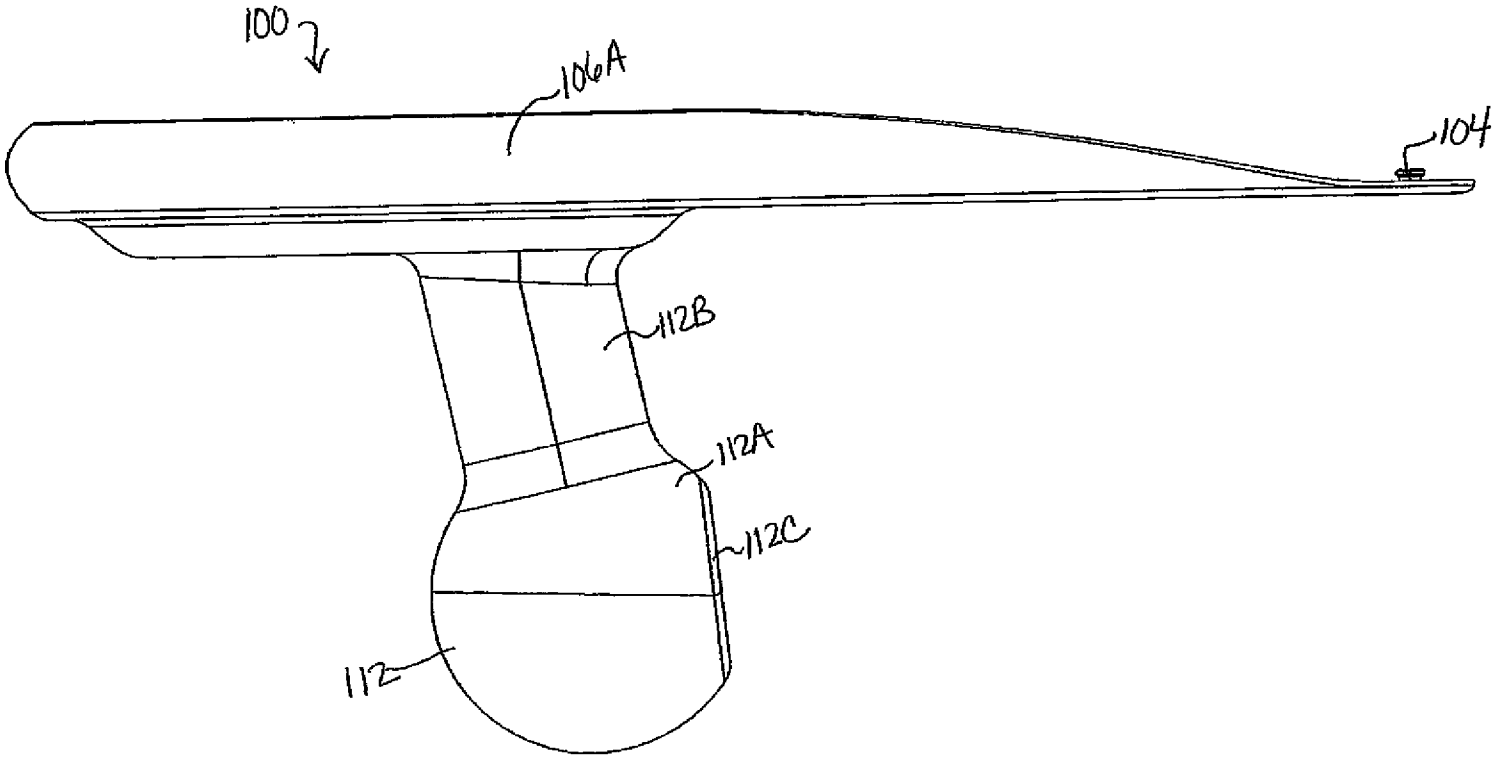
FIG. 2 is a side view of the bib apparatus shown in FIG. 1.

As shown in FIG. 2, in an example embodiment, reservoir member 112 can hang at an angle towards the infant's chest and can rest on the chest so as to hold the shelf up under the infant's chin. In one example embodiment, reservoir member 112 is comprised of a wide spherical base 112A and a neck 112B that is congruous with shelf 102. Neck 112B is of a sufficient length and narrowness so that an infant cannot reach inside the reservoir member to access liquid, and so that liquid cannot spill back out of reservoir member 112, for instance, when an infant wiggles or moves, or while feeding or burping positions are alternated. The neck portion could also be just wide enough to allow for cleaning with bottle brush.

Referring again to FIG. 2, in another example embodiment, reservoir member 112 can contain a flat side 112C that can rest against the infant's torso so as to facilitate stability of the shelf above it, and to allow a caregiver to slide his or her hand between reservoir member 112 and the infant's chest to hold the infant in an upright position while burping and without squeezing reservoir member 112.

In various related embodiments, reservoir member 112 may be made of a reusable material such as plastic, rubber, or other material known to those of ordinary skill, or may be made from a disposable material. The reusable reservoir member 112 is capable of having the contents therein discarded and washed, while a disposable reservoir member 112 would detach from the bib apparatus 100 and be discarded in its entirety.

While the various embodiments of the invention have been described above in terms of specific embodiments, it is to be understood that the invention is not limited to these disclosed embodiments. Upon reading the teachings of this disclosure, many modifications and other embodiments or uses of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A protective bib comprising:

a plate member having a top surface and a bottom surface, the top surface having an outer rim which curves upwards and a recessed surface, the recessed surface having therein a drain hole extending from the top surface through to the bottom surface, and an inner rim configured to be disposed adjacent to a user's neck and disposed about a collar portion inboard from the outer rim;

a reservoir member having an upper neck end and a lower base end, the upper neck end coupled to the bottom surface of the plate member and about the drain hole, the reservoir member configured to support the plate member substantially horizontal to and under a user's chin when the lower base end of the reservoir member is in contact with a user's chest, the reservoir member configured to protrude at an angle toward the user when holding the plate member horizontally, the reservoir member further configured to collect liquid and debris exiting the recessed surface through the drain hole; and the collar portion disposed laterally from the outer rim and adjacent to the plate member with the collar portion including a closure mechanism, the collar portion configured to provide additional support of the plate member under a user's chin and to channel liquid onto the recessed surface.

2. The bib of claim 1 wherein the reservoir member has a one-way valve.

3. The bib of claim 1, wherein the reservoir member is selected from the group consisting of a rigid plastic bulb, a rubber bulb, a bulb configured from a disposable material, fabric, and a bag.

4. The bib of claim 3, wherein the reservoir member is connected to the drain hole by a fastening system selected from the group consisting of a snap-fit, a threaded fit, and a friction fit.

5. The bib of claim 1, wherein a shape of the reservoir member is selected from the group consisting of a sphere, cylinder and oval.

6. The reservoir member of claim 5, wherein the reservoir member is configured to have a flat side for resting on the user's chest.

7. The bib of claim 1, wherein the collar portion is configured to be expandable for sizing to accommodate users of various sizes.

8. The bib of claim 1, wherein the reservoir member is configured to have an elongate neck end that is coupled to a bulbous base end to ensure fluid does not flow back out onto the plate member.

9. The bib of claim 8, wherein the plate member is positionable substantially horizontal to the user by varying a distance between the elongate neck end and the bulbous base end, and wherein the base end includes a flat portion configured to be in contact with the user's chest and stabilize the plate member.

10. A protective bib comprising:

a plate member having a top surface, and a bottom surface, the top surface having an outer rim and a recessed surface, the recessed surface having therein a drain hole extending from the top surface through to the bottom surface, wherein the plate member further comprises an inner rim configured to be adjacent the user's chin and inboard of the outer rim, and a support means operatively coupled to the bottom surface of the plate member and about the drain hole, said support means configured to support the plate member horizontally under a user's chin.

11. The bib of claim 10 wherein said support means comprises a reservoir member having an upper neck end and a lower base end, the upper neck end coupled about the drain hole and coupled to the bottom surface of the plate member, the reservoir member configured to support the plate member under the user's chin and to collect liquid and debris exiting the recessed surface through the drain hole.

12. The bib of claim 11, wherein the reservoir member is configured to be expandable in length for sizing to accommodate users of various sizes.

13. The bib of claim 10, wherein the shape of the plate member is selected from the group consisting of a circle, oval, square, and rectangle.

14. The bib of claim 13 wherein the bib is comprised of a material selected from rubber, plastic, and disposable material.

15. A protective bib comprising:

a plate member having a top surface and a bottom surface, the top surface having an outer rim which curves upwards and a recessed surface, the recessed surface having therein a drain hole extending from the top surface through to the bottom surface;

a reservoir member having an upper neck end, a lower base end, and an elongate neck, the upper neck end coupled to the bottom surface of the plate member and about the drain hole, the elongate neck coupled to a bulbous base end to ensure fluid does not flow back out onto the plate member, the reservoir member configured to support the plate member substantially horizontal to and under a user's chin when the lower base end of the reservoir member is in contact with a user's chest, the reservoir member configured to protrude at an angle toward the user when holding the plate member horizontally, the reservoir member further configured to collect liquid and debris exiting the recessed surface through the drain hole; and a collar portion disposed laterally from the outer rim and adjacent to the plate member with the collar portion including a closure mechanism, the collar portion configured to provide additional support of the plate member under a user's chin and to channel liquid onto the recessed surface;

wherein the plate member is positionable substantially horizontal to the user by varying a distance between the elongate neck end and the bulbous base end, and wherein the base end includes a flat portion configured to be in contact with the user's chest and stabilize the plate member.

* * * * *